US005886612A

United States Patent [19]

Beckert et al.

[11] Patent Number: 5,886,612

[45] Date of Patent: Mar. 23, 1999

[54] FEMALE FUSE HOUSING

[75] Inventors: James J. Beckert, Elgin; Seibang Oh, Elk Grove Village; David M. Biggs, Sr., Lake Villa, all of Ill.

[73] Assignee: Littelfuse, Inc., Des Plaines, Ill.

[21] Appl. No.: 953,898

[22] Filed: Oct. 20, 1997

[51] Int. Cl.[6] ..... H01H 85/02; H01H 85/165; H01H 85/175; H01H 85/04

[52] U.S. Cl. ..... 337/197; 337/186; 337/187; 337/192; 337/227; 337/228

[58] Field of Search ..... 337/197, 198, 337/260–265, 295, 161, 251, 255, 186, 187, 192, 227, 228; 439/250, 621, 622, 366, 830–833

[56] References Cited

U.S. PATENT DOCUMENTS

| | | | |
|---|---|---|---|
| 33,137 | 12/1861 | Gurevich et al. | 337/255 |
| 2,649,522 | 8/1953 | Marcus | 200/115.5 |
| 2,774,951 | 12/1956 | Kinkaid et al. | 339/258 |
| 2,903,539 | 9/1959 | Matthysse et al. | 200/129 |
| 2,921,287 | 1/1960 | Matthysse et al. | 339/258 |
| 2,996,026 | 8/1961 | Batcheller | 113/119 |
| 3,139,318 | 6/1964 | Binder et al. | 339/256 |
| 3,148,257 | 9/1964 | Feenan et al. | 200/135 |
| 3,288,968 | 11/1966 | Feenan et al. | 200/135 |
| 3,409,867 | 11/1968 | Lessner | 339/258 |

(List continued on next page.)

FOREIGN PATENT DOCUMENTS

| | | |
|---|---|---|
| 228 490A1 | 7/1987 | European Pat. Off. . |
| 0463608 A3 | 1/1992 | European Pat. Off. . |
| 633592A1 | 1/1995 | European Pat. Off. . |
| 1312116 | 11/1962 | France . |
| 1567727 | 5/1969 | France . |
| 2557355 | 12/1989 | France . |
| 30 40 884 A1 | of 0000 | Germany . |
| 1615002 | 5/1970 | Germany . |
| 2517069 | 10/1976 | Germany . |
| 27 14 797-1 | 2/1979 | Germany . |
| 43 40 979 A 1 | 7/1994 | Germany . |
| 626449 | 10/1961 | Italy . |
| 3-3560 | of 0000 | Japan . |
| 56-53 | 1/1981 | Japan . |
| 57-15141 | 9/1982 | Japan . |
| 57-210537 | 12/1982 | Japan . |
| 59-16054 | 1/1984 | Japan . |
| 59-178857 | 11/1984 | Japan . |
| 60-177527 | 9/1985 | Japan . |
| 61-294730 | 2/1986 | Japan . |
| 61-61331 | 3/1986 | Japan . |
| 61-166449 | 10/1986 | Japan . |
| 61-166450 | 10/1986 | Japan . |
| 61-240521 | 10/1986 | Japan . |
| 61-271731 | 12/1986 | Japan . |
| 64-60937 | 3/1989 | Japan . |
| 1-241728 | 9/1989 | Japan . |
| 1-241729 | 9/1989 | Japan . |
| 1-315924 | 12/1989 | Japan . |
| 2-66828 | 6/1990 | Japan . |
| 2-89753 | 7/1990 | Japan . |
| 2-199735 | 8/1990 | Japan . |
| 5-172050 | 7/1993 | Japan . |
| 5-205608 | 8/1993 | Japan . |
| 5-274995 | 10/1993 | Japan . |
| 6-13043 | 2/1994 | Japan . |
| 6-48149 | 6/1994 | Japan . |
| 720592 | 3/1980 | Russian Federation . |
| 858115 | 1/1961 | United Kingdom . |
| 2197759 | 5/1988 | United Kingdom . |
| 2228150 | 8/1990 | United Kingdom . |

*Primary Examiner*—Leo P. Picard
*Assistant Examiner*—Anatoly Vortman
*Attorney, Agent, or Firm*—Wallenstein & Wagner, Ltd.

[57] ABSTRACT

A female fuse housing is provided for housing a fuse and includes a sidewall, a fuse insertion end, a terminal entry end, and a pliant partition. The sidewall has an inner surface and an exterior surface. The inner surface defines a fuse insertion area. The terminal entry end has first and second terminal sockets. The pliant partition is located within the fuse insertion area between the first terminal socket and the second terminal socket and substantially parallel to the longitudinal axis to define a first female receptor chamber and a second female receptor chamber.

28 Claims, 2 Drawing Sheets

U.S. PATENT DOCUMENTS

| | | | |
|---|---|---|---|
| 3,524,157 | 8/1970 | Salzer | 337/159 |
| 3,550,069 | 12/1970 | Teagno | 339/256 |
| 3,813,626 | 5/1974 | Cetola et al. | 337/245 |
| 3,995,929 | 12/1976 | Ghirardi et al. | 339/32 |
| 4,099,320 | 7/1978 | Schmidt, Jr. | 29/623 |
| 4,131,869 | 12/1978 | Schmidt, Jr. et al. | 337/264 |
| 4,196,409 | 4/1980 | Juba | 337/198 |
| 4,253,080 | 2/1981 | Howard | 337/159 |
| 4,297,666 | 10/1981 | Asdollahi | 337/163 |
| 4,310,719 | 1/1982 | Cross et al. | 174/94 |
| 4,319,213 | 3/1982 | Reid | 337/161 |
| 4,344,060 | 8/1982 | Ciesemier et al. | 337/260 |
| 4,417,225 | 11/1983 | Muller et al. | 337/198 |
| 4,430,633 | 2/1984 | Ebi | 337/166 |
| 4,448,468 | 5/1984 | Coldren | 339/74 R |
| 4,451,109 | 5/1984 | Inoue | 339/258 |
| 4,544,907 | 10/1985 | Takano | 337/262 |
| 4,553,808 | 11/1985 | Weidler et al. | 339/97 R |
| 4,556,274 | 12/1985 | Olivera | 339/147 R |
| 4,570,147 | 2/1986 | Ebi | 337/166 |
| 4,604,602 | 8/1986 | Borzoni | 337/264 |
| 4,612,529 | 9/1986 | Gurevich et al. | 337/255 |
| 4,635,023 | 1/1987 | Oh | 337/163 |
| 4,646,052 | 2/1987 | Matsumaga et al. | 337/166 |
| 4,661,793 | 4/1987 | Borzoni | 337/260 |
| 4,670,729 | 6/1987 | Oh | 3376/264 |
| 4,672,352 | 6/1987 | Takano | 337/264 |
| 4,685,754 | 8/1987 | Coldren | 439/270 |
| 4,691,981 | 9/1987 | Coldren | 439/816 |
| 4,751,490 | 6/1988 | Hatagishi | 337/295 |
| 4,764,133 | 8/1988 | Kaneko | 439/889 |
| 4,781,628 | 11/1988 | Detter et al. | 439/748 |
| 4,800,358 | 1/1989 | Takenouchi et al. | 337/268 |
| 4,808,962 | 2/1989 | Ikeda | 337/203 |
| 4,810,215 | 3/1989 | Kaneko | 439/865 |
| 4,842,534 | 6/1989 | Mobley et al. | 439/214 |
| 4,869,972 | 9/1989 | Hatagishi | 428/647 |
| 4,871,990 | 10/1989 | Ikeda et al. | 337/238 |
| 4,944,084 | 7/1990 | Horibe et al. | 29/623 |
| 4,944,697 | 7/1990 | Dorman | 439/621 |
| 4,958,426 | 9/1990 | Endo et al. | 29/623 |
| 4,975,551 | 12/1990 | Syvertson | 200/144 |
| 4,988,969 | 1/1991 | Gurevich | 337/260 |
| 4,992,062 | 2/1991 | Nakayama et al. | 439/621 |
| 5,049,095 | 9/1991 | Gugelmeyer | 439/856 |
| 5,091,712 | 2/1992 | Suuronen | 337/297 |
| 5,106,324 | 4/1992 | Natsume | 439/510 |
| 5,139,443 | 8/1992 | Armando | 439/620 |
| 5,147,230 | 9/1992 | Plyler et al. | 439/843 |
| 5,181,866 | 1/1993 | Jerome et al. | 439/850 |
| 5,229,739 | 7/1993 | Oh et al. | 337/290 |
| 5,262,751 | 11/1993 | Kudo et al. | 337/296 |
| 5,281,175 | 1/1994 | Chupak et al. | 439/839 |
| 5,293,147 | 3/1994 | Oh et al. | 337/227 |
| 5,294,906 | 3/1994 | Totsuka et al. | 337/260 |
| 5,346,411 | 9/1994 | N ikkinen | 439/621 |
| 5,350,321 | 9/1994 | Takenouchi | 439/839 |
| 5,357,234 | 10/1994 | Pimpis et al. | 337/246 |
| 5,361,058 | 11/1994 | Mosesian et al. | 337/163 |
| 5,374,590 | 12/1994 | Batdorf et al. | 437/173 |
| 5,488,345 | 1/1996 | Seki et al. | 337/186 |
| 5,488,346 | 1/1996 | Kondo et al. | 337/198 |

FEMALE FUSE HOUSING

FIELD OF THE INVENTION

The present invention relates to female fuse housings. More particularly, the present invention relates to female fuse housings which accept male terminals therein.

BACKGROUND OF THE INVENTION

Generally, fuses used in automobiles, and connected within a fuse box, are male fuses consisting of two terminals connected by a fuse element. This combination is typically encased in a housing made of an insulating material. The male fuse is adapted for plugging into the fuse box. The fuse box, therefore, typically includes female receptors or terminals for receiving the male fuse.

Many problems are associated with this arrangement. For instance, the female receptors in the fuse box contain spring loaded metallic elements for engaging the male terminals. These female receptors are easily damaged when the male terminals are forced into the female receptors.

Frequent changing of the male fuses also leads to excessive wear and tear on the female fuse receptors within the fuse box. This can cause premature failure of components within the fuse box and subsequent replacement of the entire fuse box. A procedure that is costly and time consuming.

To improve these problems the automotive industry has increasingly turned to female fuses coupled with fuse boxes that have male terminals extending therefrom. By moving the male terminals from the fuse to the fuse box, moving parts associated with the spring-loaded female receptors are transferred from the box to the fuse. The male terminals can be produced to withstand the wear and tear produced by replacing the fuses. Therefore, the frequency with which automotive fuse boxes must be replaced will decrease.

As the trend toward female fuses has progressed, the need for insulating fuse housings capable of shielding the spring-loaded female receptors has increased. Early attempts at providing a female fuse with a suitable insulating housing were met with mixed results. Many of the early housings were very rigid and inflexible. As the fuses were assembled, the fuse elements would often be damaged as they were force fit into the housings. Moreover, once inserted into the housing the fuse elements were often loose and easily damaged.

One such early attempt at providing a suitable female fuse housing is disclosed in U.S. Pat. No. 4,871,990 issued to Ikeda et al. ("Ikeda"). Ikeda provides a female fuse housing having an insulating partition. The insulating partition divides the interior of the housing into two compartments adapted for receiving female receptors. Ikeda's insulating partition prevents melted fuse member ends from shorting after the fuse member has been blown out.

However, the insulating partition of Ikeda is rigid and inflexible, and in order to maintain a snug fit within the housing, the locking tab on the female fuse terminal must be deformed as it is forced into the housing. This deformation has both elastic and plastic effects on the female fuse with the plastic deformation causing the fuse to lose its original shape. Thus, the locking tabs of the female fuse terminals will not ordinarily fit tightly within the housing unless manufacturers adhere to very tight tolerances in producing the fuses and the housings.

It is more preferable to have the deformation occur in the housing rather than the fuse terminals because the housing, produced from a polymer, will experience elastic deformation over a wider range of stresses. Therefore, the need has developed for a more flexible female fuse housing that allows for easy fuse assembly and also provides a snug fit within the housing, while at the same time insulating the fuse to prevent short circuits.

Furthermore, the tabs (sometimes referred to as lances) of female fuse terminals, upon insertion into the female fuse housing, will sometimes be deformed so significantly that the these tabs will no longer engage the housing in a manner that will accomplish keeping the fuse terminals "locked" in place. Under these circumstances, the entire fuse, or at least one of the female fuse terminals, will be free to move within the housing, with the potential for the fuse link to engage the fuse cap, and even push the fuse cap open. The present invention provides a solution for the above-referenced, and other, problems.

SUMMARY OF THE INVENTION

The present invention is a housing for a female fuse. The housing comprises a sidewall, a fuse insertion end, a terminal entry end, and a pliant partition. The housing is generally produced from a suitable electrically insulating material.

The sidewall is centered about a longitudinal axis and has a proximal end and a distal end. The sidewall further comprises an inner surface and an exterior surface. The inner surface defines a fuse insertion area which is adapted for housing a female fuse.

The fuse insertion end is located at the proximal end of the sidewall. This fuse insertion end has an opening. The opening is adapted for receiving the female fuse.

The terminal entry end is located at the distal end of the sidewall. The terminal entry end comprises a first terminal socket and a second terminal socket. The first and second terminal sockets are adapted to receive male terminals that project from a fuse box.

The pliant partition is located within the fuse insertion area. The pliant partition extends upward from an interior side of the terminal entry end and substantially parallel to the longitudinal axis. The pliant partition is generally rectangular in shape, and is interconnected to the interior side of the terminal entry end along a first edge and the inner surface of the sidewall along second and third edges. A fourth edge defines a free end.

This pliant partition provides an insulating shield between the female receptors. Accordingly, the pliant partition divides a portion of the interior of the female housing into two chambers. One female receptor is positioned within each chamber so that the pliant partition insulates the female receptors from electrical shorting.

Other advantages and aspects of the present invention will become apparent upon reading the following description of the drawings and detailed description of the invention.

DETAILED DESCRIPTION OF THE PREFERRED EMBODIMENT

Figure 1:
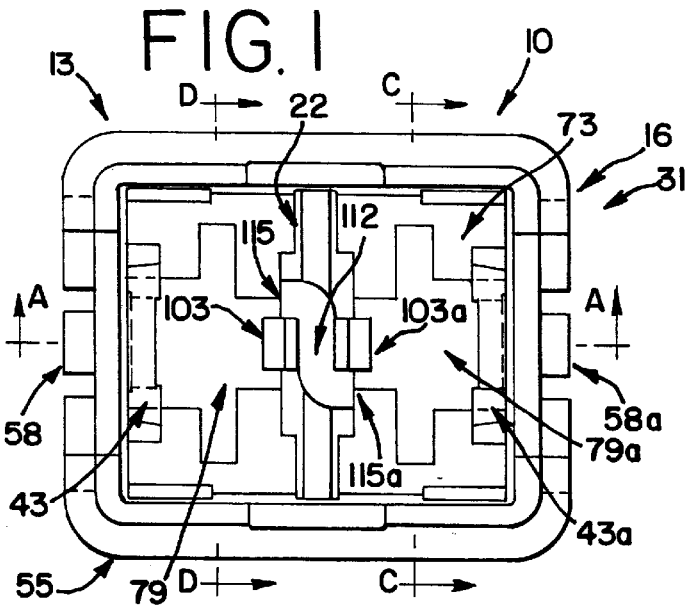
FIG. 1 is a top view of a female fuse housing.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Figure 2A:
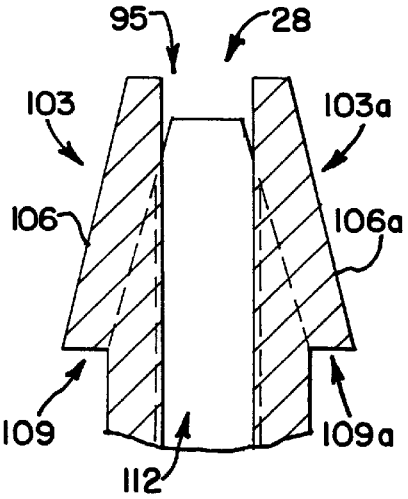
FIG. 2*a* is a sectional view taken along B—B of FIG. 2.
Figure 2:
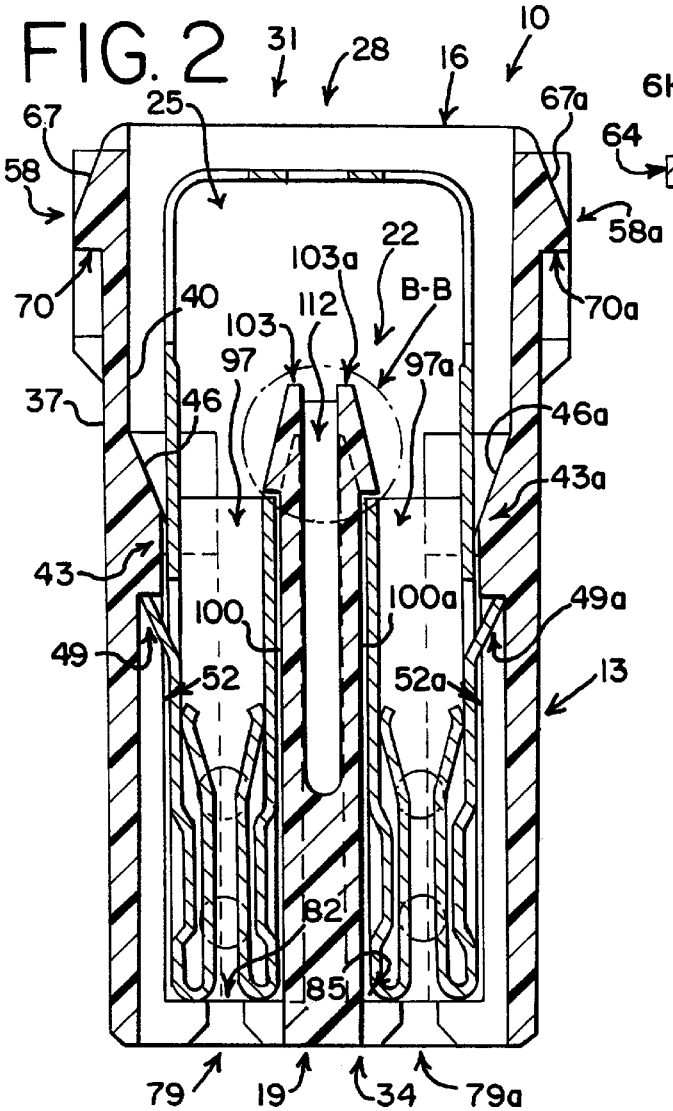
FIG. 2 is a sectional view taken along A—A of a female fuse housing.

Referring to FIGS. 1 and 2, a female fuse housing 10 of the present invention is illustrated. The female fuse housing is provided for use female fuses. One such use is with a female fuse of the type disclosed within U.S. Pat. No. 5,581,225. Another such use is with a female fuse of the type disclosed within International Application No. PCT/US96/05628. The disclosures in both U.S. Pat. No. 5,581,225 and International Application No. PCT/US96/05628 are hereby incorporated by reference within the present specification.

The female fuse housing 10 of the present invention includes a sidewall 13, a fuse insertion end 16, a male terminal entry end 19, and a pliant partition 22. The sidewall 13, the fuse insertion end 16, and the male terminal entry end 19 define a fuse insertion area 25 for housing the female fuse. The female fuse housing 10 is generally produced from an insulating polymer resin.

The sidewall 13 is centered about a longitudinal axis 28 and has a proximal end 31 and a distal end 34. The sidewall 13 of the embodiment shown in FIG. 1 is rectangular. However, the sidewall 13 can exhibit a variety of shapes and sizes without departing from the spirit of the invention.

Figure 3:
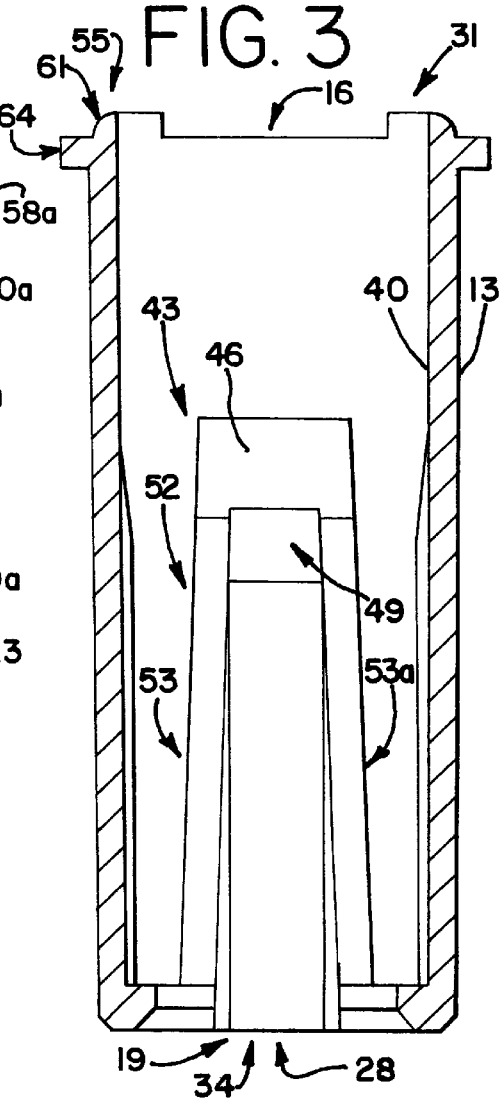
FIG. 3 is a sectional view taken along C—C of a female fuse housing.

The sidewall 13 comprises an exterior surface 37 and an inner surface 40. As seen in FIGS. 1 and 3, the inner surface 40 of the preferred embodiment exhibits first and second retaining ledges 43, 43*a* for engaging portions of the female fuse. The retaining ledges 43, 43*a* aid in preventing horizontal and vertical displacement of the female fuse within the housing 10. The retaining ledges 43, 43*a* illustrated have first and second ramped portions 46, 46*a*. The first and second ramped portions 46, 46*a* extend from the inner surface 40 and angle downward toward the distal end 34 and inward toward the longitudinal axis 28. The first and second ramped portions 46, 46*a* terminate at first and second corner portions 49, 49*a* respectively. These first and second corner portions 49, 49*a* are angled approximately perpendicular to and are directed toward the inner surface 40 and away from the longitudinal axis 28. As the female fuse is inserted into the housing 10, elastic male protrusions connected to the female fuse contact the first and second ramped portions 46, 46*a* and slide down their surfaces. The male protrusions are elastically deformed into the fuse as they slide down the first and second ramped portions 46, 46*a*. When the male protrusions reach the first and second corner portions 49, 49*a* the male protrusions snap back into their original positions and are retained against the first and second corner portions 49, 49*a*. This structure serves to keep the fuse from being accidently withdrawn or pushed from the housing 10.

Referring to FIGS. 2 and 3, the inner surface 40 also includes first and second guide channels 52, 52*a*. Each guide channel appears as a pair of rail-like structures 53, 53*a* which project outward from the inner surface 40. The first and second guide channels 52, 52*a* are interconnected to the first and second retaining ledges 43, 43*a* and extend from the retaining ledges 43, 43*a* downward toward the distal end 34 and approximately parallel to the longitudinal axis 28. The female fuse's male protrusions fit within the first and second guide channels 52, 52*a* to restrict horizontal displacement of the fuse within the housing 10.

Figure 4:
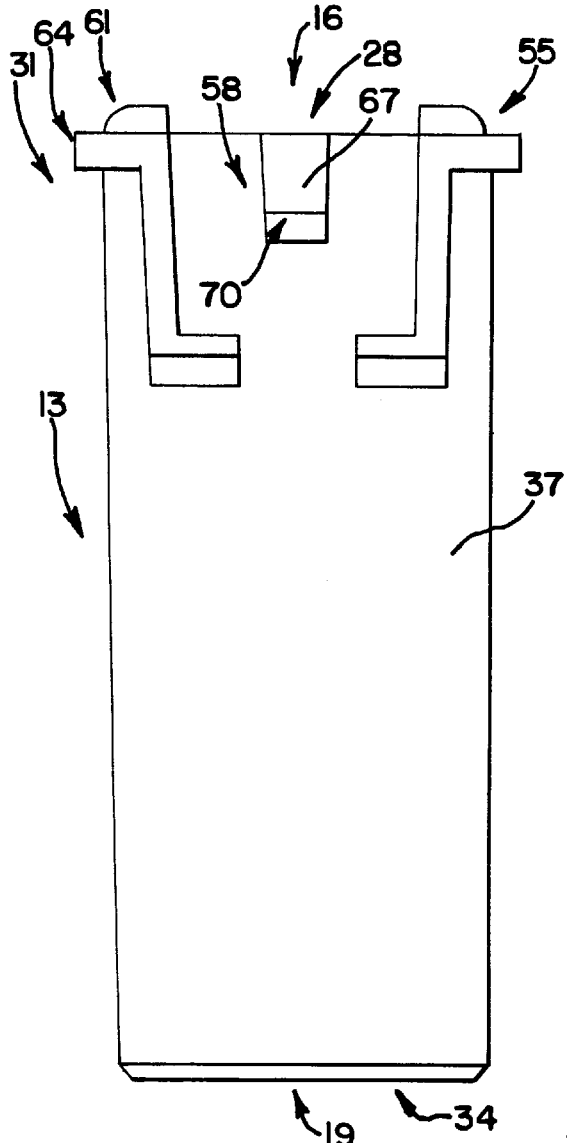
FIG. 4 is a side view of a female fuse housing.

Referring to FIGS. 2, 3, and 4, the exterior surface 37 of the sidewall 13 includes a lipped portion 55 and first and second latch keepers 58, 58*a*. The lipped portion 55 and latch keepers 58, 58*a* are located proximate the fuse insertion end 16. The lipped portion 55 and latch keepers 58, 58*a* cooperate to allow a translucent cap to be placed over the fuse insertion end 16. The lipped portion 55 comprises a vertical shelf 61 and a horizontal shelf 64. The vertical shelf 61 interconnects to the sidewall 13 at the fuse insertion end 16. The translucent cap fits over the vertical shelf 61 which engages an interior portion of the translucent cap to prevent the translucent cap from shifting horizontally. The horizontal shelf 64 engages an exterior portion of the translucent cap and prevents the translucent cap from shifting vertically.

Referring to FIG. 2, the latch keepers 58, 58*a* are similar in structure to the retaining ledges 43, 43*a* located on the inner surface 40 of the sidewall 13. Accordingly, the latch keepers 58, 58*a* have first and second tapered portions 67, 67*a* which angle downward toward the distal end 34 and outward away from the longitudinal axis 28. The latch keepers 58, 58*a* terminate forming first and second 90° bends 70, 70*a* respectively. The 90° bends 70, 70*a* retain a latch located on the translucent cap.

The fuse insertion end 16 is located at the proximal end 31 of the sidewall 13. The fuse insertion end 16 comprises an opening 73 for receiving a female fuse. The profile of the opening 73 is defined by the general shape of the sidewall 13. (See FIG. 1).

Figure 6:
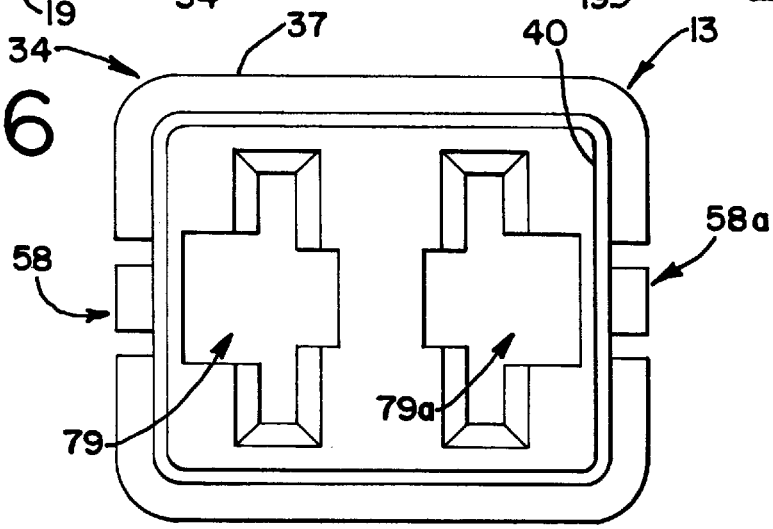
FIG. 6 is a bottom view of a female fuse housing.

FIG. 2 further shows that the male terminal entry end 19 is located at the distal end 34 of the sidewall 13. The male terminal entry end 19 comprises a first terminal socket 79 and a second terminal socket 79*a*. The first and second terminal sockets 79, 79*a* are adapted to receive male terminals that project from a male fuse box. In the preferred embodiment, the first and second terminal sockets 79, 79*a* are parallel to each other and in mirror image relationship. (See FIG. 6).

Figure 5:
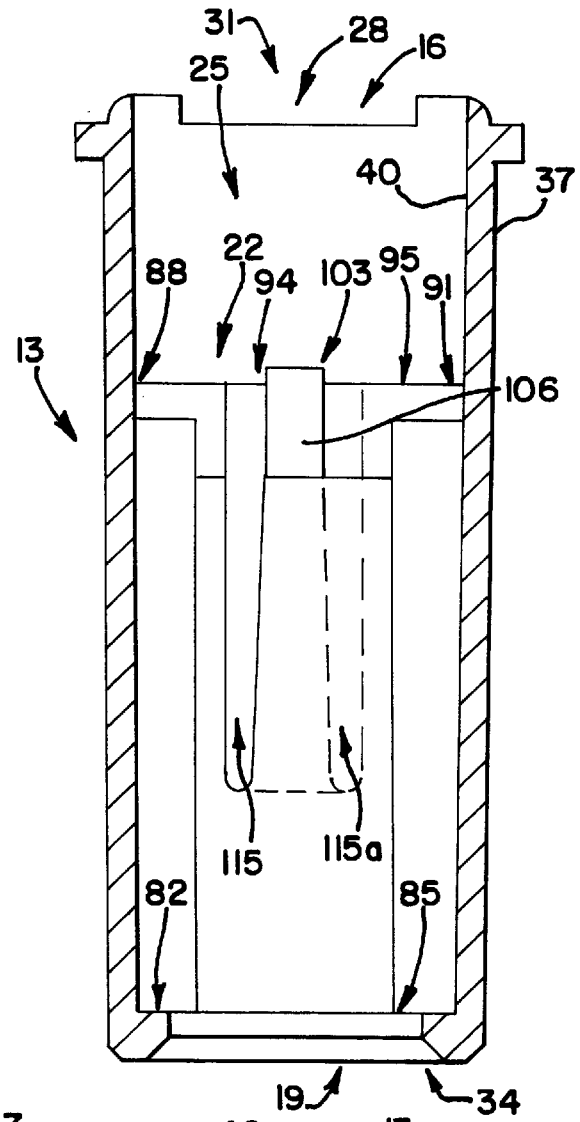
FIG. 5 is a sectional view taken along D—D of a female fuse housing.

Additionally, referring to FIG. 5, the pliant partition 22 is located within the fuse insertion area 25. In the preferred embodiment, the pliant partition 22 extends from an interior side 82 of the male terminal entry end 19 upward toward the proximal end 31 and substantially parallel to the longitudinal axis 28. The pliant partition 22 is generally rectangular in shape. Accordingly, the pliant partition 22 has four edges. The first edge 85 is interconnected to the interior side 82 of the male terminal entry end 19 between the first and second sockets 79, 79*a*. The second and third edges 88, 91 are interconnected to the inner surface 40 of the sidewall 13 between the first and second retaining ledges 43, 43*a*. The fourth edge 94 defines a free end 95. This structure defines a first female receptor/terminal chamber 97 and a second female receptor/terminal chamber 97*a* for housing the first and second female receptors or terminals of a female fuse.

The pliant partition 22 further comprises a first female receptor engaging surface 100 and a second female receptor engaging surface 100*a*. The first female receptor engaging surface 100 has a first female receptor retaining barb 103. The second female receptor engaging surface 100*a* has a second female receptor retaining barb 103*a*. The first and second female receptor retaining barbs 103, 103*a* are similar in structure to the retaining ledges 43, 43*a* and the latch keepers 58, 58*a*. Again, the retaining barbs 103, 103*a* exhibit first and second slanted surfaces 106, 106*a* respectively which begin approximately at the free end 95 of the pliant partition 22. (See FIG. 2*a*). The retaining barbs 103, 103*a* extend downward toward the distal end 34 and outward away from the longitudinal axis 28 terminating at first and second abutments 109, 109*a*. The abutments 109, 109*a* are angled to about 90°. The abutments 109, 109*a* serve to engage portions of the female receptors and further inhibit horizontal and vertical displacement of the fuse within the housing 10.

The combination of the first and second retaining barbs 103, 103*a* and the first and second retaining ledges 43, 43*a* provides a secure method of maintaining the female fuse in proper position within the housing 10. The unique feature of having a plurality of fuse retaining mechanisms within each chamber 97, 97*a* of the housing 10 is a marked improvement over prior art housings. These fuse retainers not only prevent the fuse from being withdrawn from the housing 10 but also prevent excessive shifting or tilting by the female fuse within the housing 10 as it is applied to or removed from the fuse box. Thus, less stress is transferred from the female fuse and the housing 10 to the fuse box and its components, and therefore, the useful life of the fuse box can be extended.

Referring to FIGS. 1 and 2, the pliant partition 22 further comprises a cavity 112. The cavity 112 extends from the free end 95 downward toward the distal end 34 and parallel to the longitudinal axis 28. The cavity 112 is positioned within the pliant partition 22 between the first and second female receptor engaging surfaces 100, 100*a* and the second and third edges 88, 91. The cavity 112 allows the pliant partition 22 to flex as the fuse is inserted so that the fuse may be more easily inserted into the housing 10.

The first and second female receptor engaging surfaces 100, 10*a* further comprise a first slot 115 and a second slot 115*a* respectively. (See FIG. 5). The first and second slots 115, 115*a* are positioned adjacent the first and second female receptor retaining barbs 103, 103*a* respectively and are asymmetrically aligned. The first and second slots 115, 115*a* are in communication with the cavity 112. (See FIG. 1). The resulting structure allows portions of the first and second female receptor engaging surfaces 100, 100*a* to be flexed inward toward the longitudinal axis 28 and adds lateral spring action to the first and second retaining barbs 103, 103*a* so that they can be deflected at angles to the longitudinal axis 28. Thus, the pliant partition 22 can be flexed in at least two dimensions.

In an additional embodiment, not shown in the figures, the pliant partition 22 is interconnected to the interior side 82 of the male terminal entry end 19 at the first edge 85. The second edge 88, third edge 91, and fourth edge 94 remain free. The pliant partition 22 defines a cavity 112 between the first and second female receptor engaging surfaces 100, 100*a*. This structure also allows the pliant partition 22 to flex in at least two dimensions.

While specific embodiments have been illustrated and described, numerous modifications are possible without departing from the spirit of the invention, and the scope of protection is only limited by the scope of the accompanying claims.

What is claimed is:

1. A female fuse housing for housing a fuse, comprising:

a sidewall having an inner surface and an exterior surface, the inner surface defining a fuse insertion area for housing the fuse;

a fuse insertion end, the fuse insertion end being adapted for receiving a female fuse;

a terminal entry end, the terminal entry end opposing the fuse insertion end and having a first terminal socket and a second terminal socket; and, a pliant partition positioned within the fuse insertion area between the first terminal socket and the second terminal socket defining a first female receptor chamber and a second female receptor chamber, the pliant partition having first and second female receptor engaging surfaces, one of the engaging surfaces defining a first slot.

2. The female fuse housing of claim 1 wherein the pliant partition comprises a cavity positioned between the first female receptor engaging surface and the second female receptor engaging surface.

3. The female fuse housing of claim 1 wherein the first female receptor engaging surface comprises a first female receptor retaining barb.

4. The female fuse housing of claim 3 wherein the second female receptor engaging surface comprises a second female receptor retaining barb.

5. The female fuse housing of claim 1 wherein the second female receptor engaging surface defines a second slot.

6. The female fuse housing of claim 1 wherein the first female receptor chamber includes a first female receptor retaining ledge.

7. The female fuse housing of claim 6 wherein the second female receptor chamber includes a second female receptor retaining ledge.

8. The female fuse housing of claim 1 wherein the substantially continuous sidewall comprises a lip for supporting a cover, the lip being positioned proximate the fuse insertion end.

9. The female fuse housing of claim 1 wherein the sidewall comprises at least one latch keeper for engagement by a cover, the latch keeper cooperating with the cover to secure the cover over the fuse insertion end.

10. The female fuse housing of claim 9 wherein the inner surface of the sidewall comprises at least one guide channel for receiving a portion of the fuse whereby the guide channel impedes movement of the fuse within housing.

11. A female fuse housing for housing a fuse, comprising:

a sidewall having an inner surface and an exterior surface, the inner surface defining a fuse insertion area for housing the fuse;

a fuse insertion end, the fuse insertion end being adapted for receiving a female fuse;

a terminal entry end, the terminal entry end opposing the substantially open end and having a first terminal socket and a second terminal socket; and, a pliant partition positioned within the fuse insertion area between the first terminal socket and the second terminal socket to define a first female receptor chamber and a second female receptor chamber, the pliant partition comprising a first female receptor engaging surface, a second female receptor engaging surface and a cavity positioned between the first receptor engaging surface and the second receptor engaging surface, wherein the first female receptor engaging surface defines a first slot in communication with the cavity to provide improved pliant partition flexing.

12. The female fuse housing of claim 11 wherein the first receptor engaging surface comprises a first female receptor retaining barb.

13. The female fuse housing of claim 12 wherein the second female receptor engaging surface comprises a second female receptor retaining barb.

14. The female fuse housing of claim 11 wherein the first female receptor engaging surface defines a first slot, the first slot being in communication with the cavity.

15. The female fuse housing of claim 11 wherein the second female receptor engaging surface defines a second slot, the second slot being in communication with the cavity.

16. The female fuse housing of claim 11 wherein the first female receptor chamber includes a first female receptor retaining ledge and the second female receptor chamber includes a second female receptor retaining ledge.

17. The female fuse housing of claim 13 wherein the inner surface of the sidewall comprises at least one guide channel for receiving a portion of the fuse whereby the guide channel impedes movement of the fuse within the housing.

18. A female fuse housing for housing a fuse, comprising:

a sidewall having an inner surface and an exterior surface, the inner surface defining a fuse insertion area for housing the fuse;

a fuse insertion end, the fuse insertion end being adapted for receiving a female fuse;

a terminal entry end, the terminal entry end opposing the fuse insertion end and having a first terminal socket and a second terminal socket;

a pliant partition positioned within the fuse insertion area between the first terminal socket and the second terminal socket to define a first female receptor chamber and a second female receptor chamber, the pliant partition comprising a first female receptor engaging surface, a second female receptor engaging surface, and a cavity between the first female receptor engaging surface and the second female receptor engaging surface, for providing improved pliant partition to flexing;

a first slot, the first slot being positioned on the first female receptor engaging surface and in communication with the cavity; and, a second slot, the second slot being positioned on the second female receptor engaging surface and in communication with the cavity, the first and second slots also allowing the pliant partition to flex.

19. A female fuse housing for a female fuse, the female fuse including a fuse link having first and second ends, a fuse-blowing portion positioned between the first and second ends, and first and second female fuse terminals coupled to the respective first and second ends of the fuse link, the female fuse terminals each having an upper interior edge and each having a lance, the housing comprising:

a sidewall having an inner surface and an exterior surface, the inner surface defining a fuse insertion area for housing the female fuse;

a fuse insertion end adapted for receiving the female fuse;

a terminal entry end located opposite the fuse insertion end, and having a first terminal socket and a second terminal socket; and, a divider positioned within the fuse insertion area between the first terminal socket and the second terminal socket, having a first side and a second side, to define a first female receptor chamber and a second female receptor chamber each having a plurality of female fuse retainers wherein a first of the plurality of female fuse retainers within the first female receptor chamber takes the form of an overhanging member located toward the top of the first side of the divider, for engaging an upper interior edge of one of the female fuse receptors.

20. The female fuse housing of claim 19 wherein a first of the plurality of retainers within the second female receptor chamber is a first female retainer located within the second side of the divider.

21. The female fuse housing of claim 19 wherein the first retainer takes the form of a notch, the notch being adapted to accept the lance on the female fuse terminal.

22. The female fuse housing of claim 20 wherein the first female retainer within the second female receptor chamber, takes the form of an overhanging member located toward the top of the second side of the divider, for engaging the upper interior edge of one of the female fuse terminals.

23. The female fuse housing of claim 19 wherein a first of the plurality of retainers within the first female receptor chamber is a first female retainer located within the inner surface of the side wall.

24. The female fuse housing of claim 19 wherein a first of the plurality of retainers within the second female receptor chamber is a first female retainer located within the inner surface of the side wall.

25. The female fuse housing of claim 23 or 24 wherein the first female retainer takes the form of a notch, the notch being adapted to accept the lance on the female fuse terminal.

26. The female fuse housing of claim 24 wherein the first female retainer within the second female receptor chamber, takes the form of an overhanging member located within the inner surface of the side wall, for engaging the upper interior edge of one of the female fuse terminals.

27. The female fuse housing of claim 19 further comprising a cover, wherein the sidewall of the fuse housing further comprises a lip positioned proximate the fuse insertion end, for engagement with the cover.

28. A female fuse housing for housing a fuse comprising: a fuse insertion end, the fuse insertion end being adapted for receiving a female fuse;

a sidewall having at least one latch keeper for engagement by a cover, the latch keeper cooperating with the cover to secure the cover over the fuse insertion end and; having an inner surface and an exterior surface, the inner surface defining a fuse insertion area for housing the fuse, the inner surface of the sidewall having at least one guide channel for receiving a portion of the fuse, the guide channel impeding movement of the fuse within the housing;

a terminal entry end, the terminal entry end opposing the fuse insertion end and having a first terminal socket and a second terminal socket; and, a pliant partition positioned within the fuse insertion area between the first terminal socket and the second terminal socket defining a first female receptor chamber and a second female receptor chamber.

* * * * *